US008559862B2

(12) United States Patent
Kondo et al.

(10) Patent No.: US 8,559,862 B2
(45) Date of Patent: Oct. 15, 2013

(54) IMAGE FORMING DEVICE HAVING VENTILATOR FOR ALLOWING AIR TO FLOW IN SPACE BETWEEN FUSING MEMBER AND STAY

(75) Inventors: Tomohiro Kondo, Aichi (JP); Kei Ishida, Aichi (JP); Noboru Suzuki, Komaki (JP); Yoshihiro Miyauchi, Ama (JP); Yasushi Fujiwara, Itami (JP); Tsuneo Fujiwara, legal representative, Itami (JP); Etsuko Fujiwara, legal representative, Itami (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 249 days.

(21) Appl. No.: 13/031,487

(22) Filed: Feb. 21, 2011

(65) Prior Publication Data

US 2011/0206409 A1 Aug. 25, 2011

(30) Foreign Application Priority Data

Feb. 22, 2010 (JP) ..... 2010-036168

(51) Int. Cl.
*G03G 15/20* (2006.01)
*G03G 21/20* (2006.01)

(52) U.S. Cl.
USPC ..... 399/329; 399/92

(58) Field of Classification Search
USPC ..... 399/33, 92, 329
See application file for complete search history.

(56) References Cited

U.S. PATENT DOCUMENTS

| | | | | |
|---|---|---|---|---|
| 5,278,618 | A * | 1/1994 | Mitani et al. | 399/329 |
| 6,505,018 | B2 * | 1/2003 | Fukutome | 399/92 |
| 6,920,304 | B2 * | 7/2005 | Kanesawa et al. | 399/328 |
| 7,184,698 | B2 * | 2/2007 | Tombs | 399/341 |
| 7,233,762 | B2 * | 6/2007 | Kunii et al. | 399/307 |
| 7,242,895 | B2 | 7/2007 | Inada et al. | |
| 2001/0048822 | A1 * | 12/2001 | Hanyu et al. | 399/67 |
| 2002/0057934 | A1 * | 5/2002 | Ishikawa et al. | 399/328 |

(Continued)

FOREIGN PATENT DOCUMENTS

| | | | |
|---|---|---|---|
| JP | 01102591 | A * | 4/1989 |
| JP | 05181382 | A * | 7/1993 |

(Continued)

OTHER PUBLICATIONS

JP Office Action dtd Jan. 24, 2012, JP Appln. 2010-036168, English translation.

*Primary Examiner* — Walter L Lindsay, Jr.
*Assistant Examiner* — David Bolduc
(74) *Attorney, Agent, or Firm* — Banner & Whitcoff, Ltd.

(57) ABSTRACT

An image forming device includes: a heater; a nip member; a stay; fusing member; a pair of frame members; a backup member; and a ventilator. The nip member receives radiant heat from the heater. The stay has an inner surface confronting the heater and an outer surface opposing the inner surface. The fusing member surrounds the heater, the nip member and the stay. The pair of frame members is disposed at end portions of the fusing member. One frame members is formed with an inlet opening. The remaining frame member is formed with an outlet opening. The inlet and outlet openings are in fluid communication with a space between an inner peripheral surface of the fusing member and the outer surface. The backup member provides a nip region upon nipping the fusing member between the backup and nip members. The ventilator allows air to flow in the space.

12 Claims, 10 Drawing Sheets

(56) References Cited

U.S. PATENT DOCUMENTS

| | | | | |
|---|---|---|---|---|
| 2003/0035666 | A1* | 2/2003 | Ishikawa et al. | 399/329 |
| 2003/0206757 | A1* | 11/2003 | Ishikawa et al. | 399/329 |
| 2005/0008389 | A1* | 1/2005 | Kim et al. | 399/92 |
| 2005/0084307 | A1* | 4/2005 | Muratani | 399/406 |
| 2005/0185994 | A1 | 8/2005 | Inada et al. | |
| 2006/0140662 | A1* | 6/2006 | Nagase | 399/92 |
| 2006/0177250 | A1* | 8/2006 | Nakagaki | 399/328 |
| 2006/0257161 | A1* | 11/2006 | Adachi et al. | 399/92 |
| 2007/0036597 | A1* | 2/2007 | Sato et al. | 399/381 |
| 2007/0059010 | A1* | 3/2007 | Arimoto et al. | 399/69 |
| 2007/0059012 | A1* | 3/2007 | Tomine et al. | 399/69 |
| 2007/0059021 | A1* | 3/2007 | Hanashi et al. | 399/92 |
| 2007/0059023 | A1* | 3/2007 | Koshida | 399/92 |
| 2007/0065192 | A1* | 3/2007 | Daishi et al. | 399/329 |
| 2007/0092277 | A1* | 4/2007 | Miyata et al. | 399/69 |
| 2008/0232868 | A1* | 9/2008 | Ishino | 399/322 |
| 2008/0253795 | A1* | 10/2008 | Ishino | 399/92 |
| 2009/0016764 | A1* | 1/2009 | Kitozaki | 399/92 |
| 2009/0103959 | A1* | 4/2009 | Koyama et al. | 399/341 |
| 2009/0208264 | A1 | 8/2009 | Fujiwara et al. | |
| 2009/0252525 | A1 | 10/2009 | Kojima | |
| 2009/0269108 | A1* | 10/2009 | Condello et al. | 399/329 |
| 2010/0008691 | A1 | 1/2010 | Fujiwara | |
| 2010/0086335 | A1* | 4/2010 | Sugaya | 399/329 |
| 2011/0052245 | A1* | 3/2011 | Shinshi et al. | 399/92 |

FOREIGN PATENT DOCUMENTS

| | | | |
|---|---|---|---|
| JP | H06-282185 | A | 10/1994 |
| JP | 10-247026 | | 9/1998 |
| JP | 10-284218 | | 10/1998 |
| JP | H11-338331 | A | 12/1999 |
| JP | 2003-021977 | | 1/2003 |
| JP | 2005-234294 | | 9/2005 |
| JP | 2006-039184 | | 2/2006 |
| JP | 2006-047769 | A | 2/2006 |
| JP | 2008-233886 | | 10/2008 |
| JP | 2009-251172 | A | 10/2009 |
| JP | 2010-020224 | A | 1/2010 |

* cited by examiner

IMAGE FORMING DEVICE HAVING VENTILATOR FOR ALLOWING AIR TO FLOW IN SPACE BETWEEN FUSING MEMBER AND STAY

CROSS REFERENCE TO RELATED APPLICATION

This application claims priority from Japanese Patent Application No. 2010-036168 filed Feb. 22, 2010. The entire content of the priority application is incorporated herein by reference.

TECHNICAL FIELD

The present invention relates to an image forming device having a fixing device that thermally fixes a transferred developing agent image to a sheet.

BACKGROUND

A conventional thermal fixing device for an electro-photographic type image forming device includes a tubular fusing film, a heater disposed in an internal space of the fusing film, a pressure roller, a nip plate providing a nip region between the pressure roller and the fusing film, and a stay surrounding the heater and supporting the nip plate. In such a fixing device, the heater heats the nip plate to heat a surface of a recording sheet in cooperation with the fusing film, so that a developing agent image formed on the recording sheet is thermally fixed.

SUMMARY

However, in such a conventional fixing device, the stay surrounds the heater while supporting the nip plate. The temperature of the stay is increased by heat from the heater. Hence, it is likely that parts and components disposed in the vicinity of the stay are affected by the increased temperature of the stay. In view of the foregoing, it is an object of the present invention to provide an image forming device having a fixing device capable of preventing a temperature of the stay from increasing.

In order to attain the above and other objects, the present invention provides an image forming device including: a heater; a nip member; a stay; a tubular flexible fusing member; a pair of frame members; a backup member; and a ventilator. The heater is configured to radiate radiant heat. The nip member is configured to receive the radiant heat from the heater. The stay has an inner surface confronting the heater and an outer surface in opposition to the inner surface. The stay is configured to cover the heater and to support the nip member. The tubular flexible fusing member has end portions in an axial direction and an inner peripheral surface. The fusing member is configured to surround the heater, the nip member and the stay. The pair of frame members is disposed at the end portions. One of the frame members is formed with an inlet opening. The remaining one of the frame members is formed with an outlet opening. The inlet opening and the outlet opening are in fluid communication with a space defined between the inner peripheral surface and the outer surface. The backup member is configured to provide a nip region in cooperation with the fusing member upon nipping the fusing member between the backup member and the nip member. The ventilator is configured to allow air to flow in the space in the axial direction from the inlet opening to the outlet opening.

DETAILED DESCRIPTION

Figure 1:
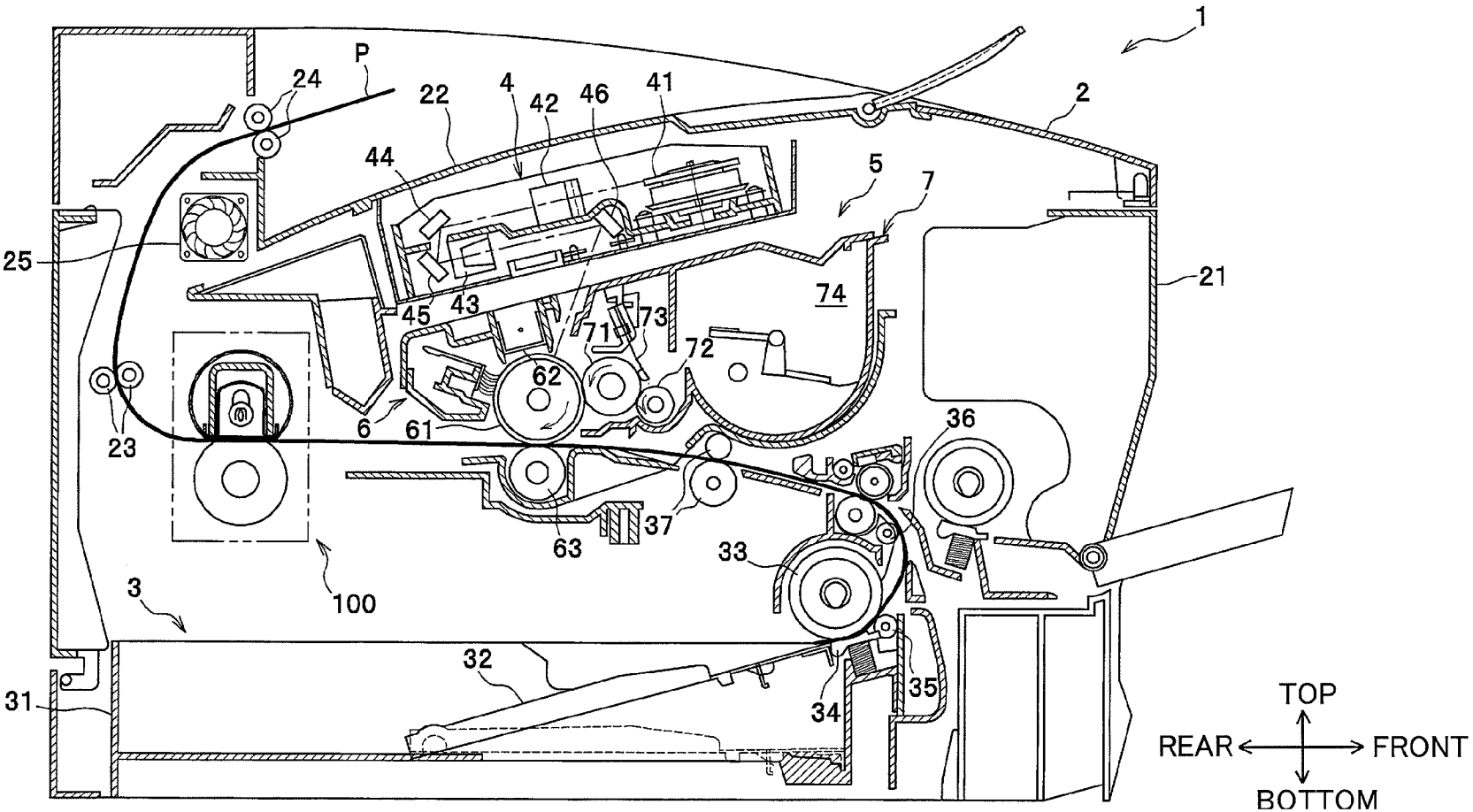
FIG. 1 is a schematic cross-sectional view showing a structure of a laser printer having a fixing device according to one embodiment of the present invention.

Next, a general structure of a laser printer as an image forming device according to one embodiment of the present invention will be described with reference to FIG. 1. The laser printer 1 shown in FIG. 1 is provided with a fixing device 100 according to the embodiment of the present invention. A detailed structure of the fixing device 100 and parts and components around thereof will be described later while referring to FIGS. 2 to 6.

<General Structure of Laser Printer>

As shown in FIG. 1, the laser printer 1 includes a main frame 2 with a movable front cover 21 and a ventilation fan 25 as a ventilator. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The main frame 2 has right and left side panels. The right side panel is provided with the ventilation fan 25 for allowing air in the main frame 2 to discharge outside of the main frame 2. More specifically, the ventilation fan 25 is disposed above the fixing device 100.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a rotatably driven polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
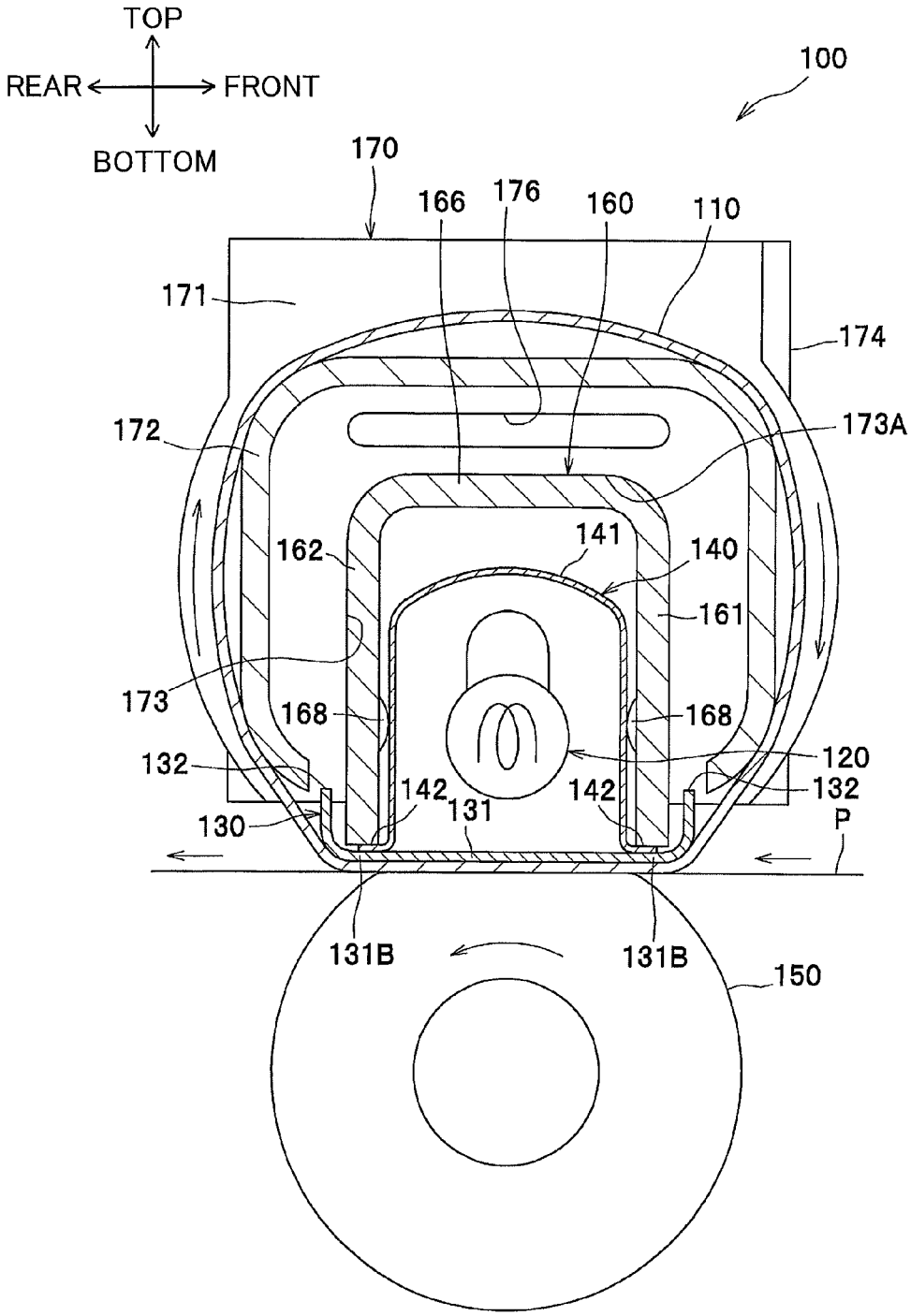
FIG. 2 is a schematic cross-sectional view showing a structure of the fixing device according to the embodiment.

As shown in FIG. 2, the fixing device 100 includes a flexible tubular fusing member such as a tube or film 110, a halogen lamp 120, a nip plate 130 as a nip member, a reflection plate 140, a pressure roller 150 as a backup member, a stay 160, and a pair of guide members 170 as frame members (regulating members).

The fusing film 110 is of a tubular configuration having heat resistivity and flexibility. The fusing film 110 is disposed so as to cover the halogen lamp 120, the nip plate 130, the reflection plate 140, and the stay 160. Each widthwise end portion of the fusing film 110 is guided by the guide member 170 (described later) fixed to a main frame of the fixing device 100 so that the fusing film 110 is circularly movable. The fusing film 110 may be a metal film or a resin film. Alternatively, the fusing film 110 may be a film whose outer circumferential surface is coated with a rubber.

Figure 3:
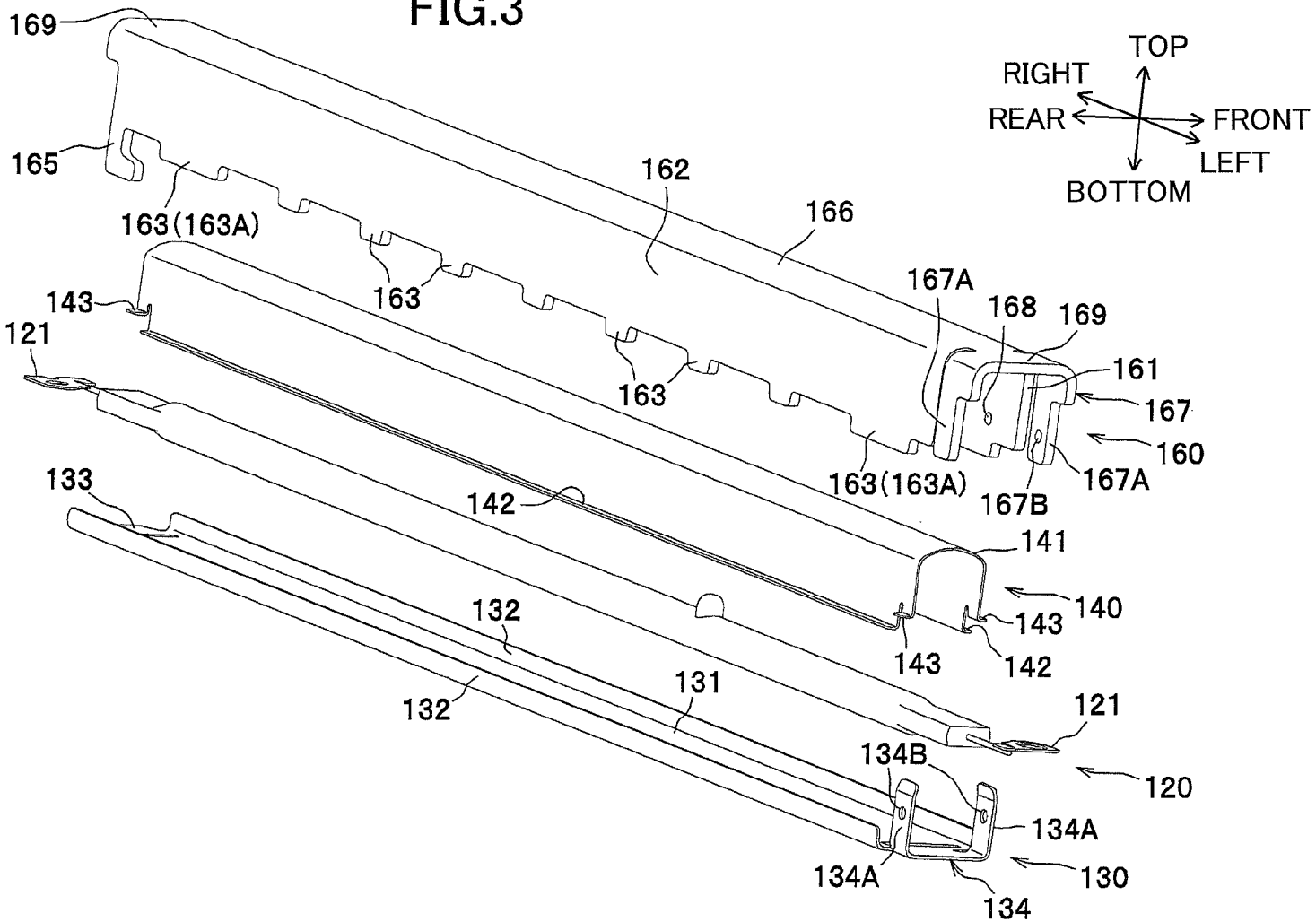
FIG. 3 is an exploded perspective view showing a halogen lamp, a nip plate, a reflection plate, and a stay.

The halogen lamp 120 is a heater to heat the nip plate 130 and the fusing film 110 for heating toner on the sheet P by generating radiant heat. The halogen lamp 120 is positioned at an internal space of the fusing film 110 and is spaced away from an inner peripheral surface of the fusing film 110 as well as from an inner surface of the nip plate 130 at a predetermined distance. The halogen lamp 120 has right and left end portions, and each end portion is provided with a terminal 121 (FIG. 3).

The nip plate 130 is adapted for receiving pressure from the pressure roller 150 and for receiving radiant heat from the halogen lamp 120. The nip plate 130 transmits radiant heat from the halogen lamp 120 to the toner on the sheet P through the fusing film 110. To this effect, the nip plate 130 is positioned such that the inner peripheral surface of the fusing film 110 is moved slidably therewith through grease. The nip plate 130 may be in direct contact with the lower surface of the fusing film 110, or may be in contact with the same via a coating layer.

The nip plate 130 has a generally U-shaped cross-section made from a material such as aluminum having a thermal conductivity higher than that of the stay 160 (described later) made of steel. More specifically, for fabricating the nip plate 130, an aluminum plate is bent into U-shape to provide a base portion 131 extending in a frontward/rearward direction and upwardly folded portions 132 (that is oriented in a direction from the pressure roller 150 to the nip plate 130).

The base portion 131 has end portions 131B in the frontward/rearward direction. The base portion 131 has an inner (upper) surface painted with a black color or provided with a heat absorbing member so as to efficiently absorb radiant heat from the halogen lamp 120.

As shown in FIG. 3, the nip plate 130 has a right end portion provided with an insertion portion 133 extending flat, and a left end portion provided with an engagement portion 134. The engagement portion 134 has U-shaped configuration as viewed from a left side including side wall portions 134A extending upward and formed with engagement holes 134B.

The reflection plate 140 is adapted to reflect radiant heat from the halogen lamp 120 radiating in the frontward/rearward direction and an upper direction toward the nip plate 130 (toward the inner surface of the base portion 131). As shown in FIG. 2, the reflection plate 140 is positioned within the internal space of the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending outward from each end portion of the reflection portion 141 in the frontward/rearward direction. A mirror surface finishing is available on the surface of the aluminum reflection plate 140 for specular reflection in order to enhance heat reflection ratio. As shown in FIG. 3, two engagement sections 143 are provided at each widthwise (right and left) end of the reflection plate 140. Each engagement section 143 is positioned higher than the flange portion 142.

As shown in FIG. 2, the pressure roller 150 is positioned below the nip plate 130. The pressure roller 150 is made from a resiliently deformable material. The pressure roller 150 is resiliently deformed to nip the fusing film 110 in cooperation with the nip plate 130 to provide a nip region for nipping the sheet P between the pressure roller 150 and the fusing film 110. In other words, the pressure roller 150 presses the nip plate 130 through the fusing film 110 for providing the nip region N between the pressure roller 150 and the fusing film 110. In order to provide the nip region, one of the pressure roller 150 and the nip plate 130 can be urged against remaining one of the pressure roller 150 and the nip plate 130 by an urging member such as a spring.

The pressure roller 150 is rotationally driven by a drive source (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region between the pressure roller 150 and the fusing film 110.

Figure 6:
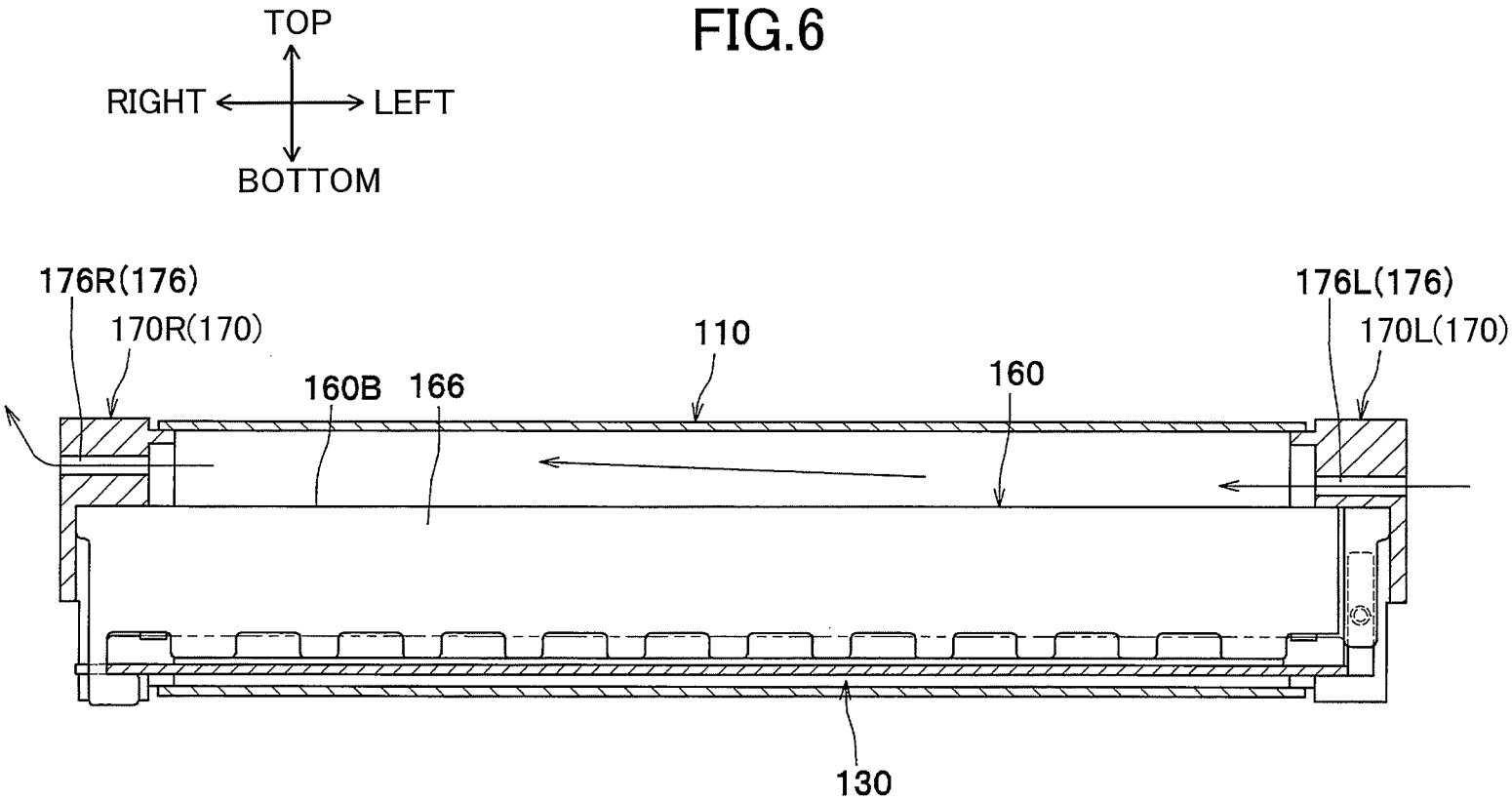
FIG. 6 is a cross-sectional view showing an assembled state of a fusing film, the nip plate, the stay, and a pair of the guide members, in which flow of air in a space defined between the stay and the fusing film is shown.

The stay 160 is adapted to support the end portions 131B of the nip plate 130 through the flange portion 142 of the reflection plate 140 for maintaining rigidity of the nip plate 130. The stay 160 has a U-shape configuration in conformity with the outer shape of the reflection portion 141 covering the reflection plate 140. More specifically, the stay 160 has an inner surface confronting the halogen lamp 120 via the reflection plate 140 and an outer surface surrounded by the fusing film 110. For fabricating the stay 160, a highly rigid member such as a steel plate is folded into U-shape to have a top wall 166, a front wall 161 and a rear wall 162. The top wall 166 has an upper surface 160B (FIG. 6). As shown in FIG. 3, each of the front wall 161 and the rear wall 162 has a lower end portion provided with comb-like contact portions 163.

As a result of assembly of the nip plate 130 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in a rightward/leftward direction (widthwise direction) due to vibration caused by operation of the fixing device 100 can be restrained by the engagement between the engagement sections 143 and the comb-like contact portions 163A.

The front and rear walls 161, 162 have right end portions provided with L-shaped engagement legs 165 each extending downward and then leftward. The insertion portion 133 of the nip plate 130 is insertable into a space between the confronting engagement legs 165 and 165. Further, each end portion 131B of the base portion 131 is abuttable on each engagement leg 165 as a result of the insertion.

The top wall 166 has a left end portion provided with a retainer 167 having U-shaped configuration. The retainer 167 has a pair of retaining walls 167A whose inner surfaces are provided with engagement bosses 167B each being engageable with each engagement hole 134B.

As shown in FIGS. 2 and 3, each widthwise (left and right) end portion of each of the front wall 161 and the rear wall 162 has an inner surface provided with two abutment bosses 168 protruding inward in abutment with the reflection portion 141 in the frontward/rearward direction. Therefore, displacement of the reflection plate 140 in the frontward/rearward direction due to vibration caused by operation of the fixing device 100 can be restrained because of the abutment of the reflection portion 141 with the bosses 168.

The stay 160 has upper left and right end portions, each provided with a supported portion 169 protruding outward in the rightward/leftward direction. The supported portion 169 is supported to the guide member 170 described later.

Assembling procedure of the reflection plate 140 and the nip plate 130 to the stay 160 will be described. First, the reflection plate 140 is temporarily assembled to the stay 160 by the abutment of the outer surface of the reflection portion 141 on the abutment bosses 168. In this case, the engagement sections 143 are in contact with the widthwise endmost contact portions 163A.

Figure 4:
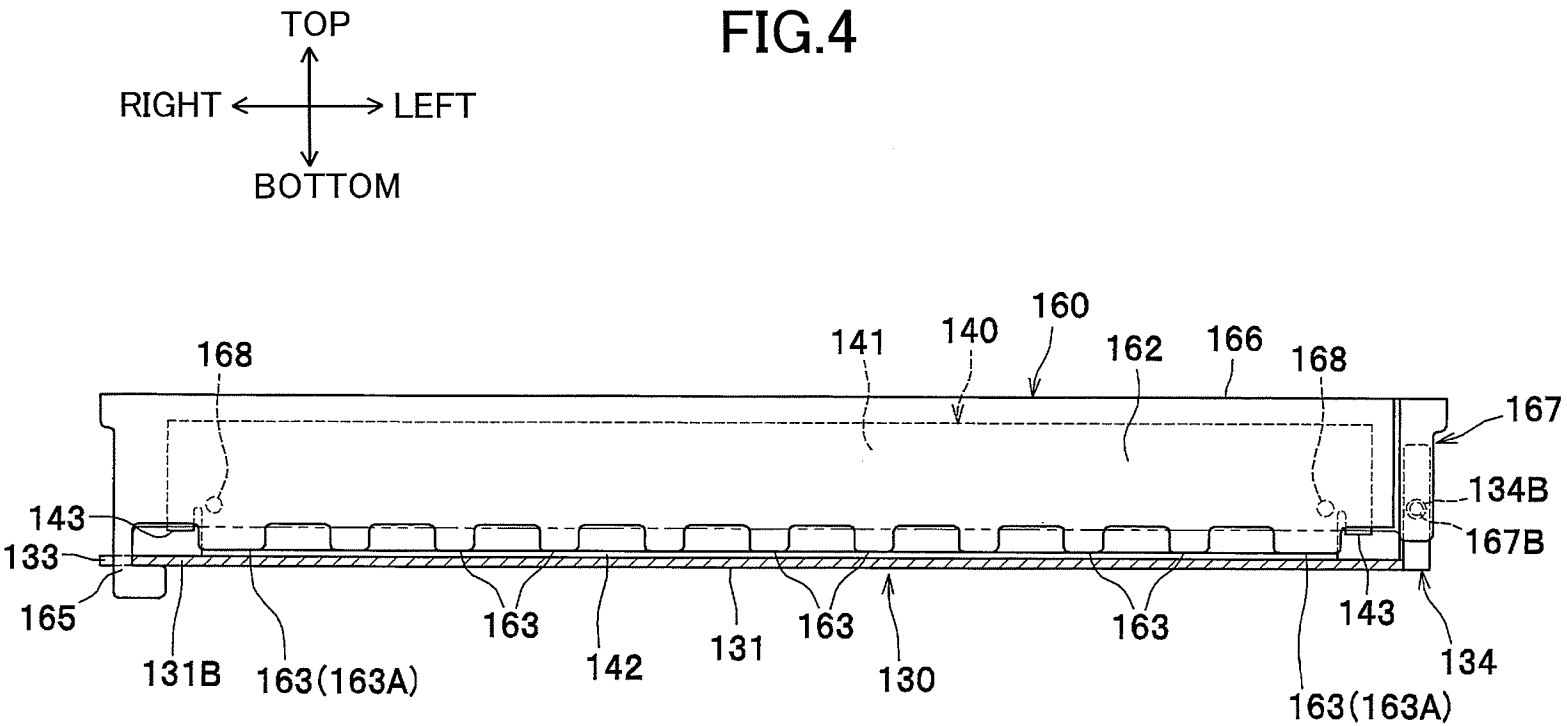
FIG. 4 is a view showing an assembled state of the nip plate, the reflection plate and the stay as viewed from a rear side thereof.

Then, as shown in FIG. 4, the insertion portion 133 is inserted between the engagement legs 165 and 165, so that the base portion 131 can be brought into engagement with the engagement legs 165. Thereafter, the engagement bosses 167B are engaged with the engagement holes 134B. By this engagement, each flange portion 142 is sandwiched between the nip plate 130 and the stay 160. Thus, the nip plate 130 and the reflection plate 140 are held to the stay 160.

Vertical displacement of the reflection plate 140 due to vibration caused by operation of the fixing device 100 can be restrained, since the flange portions 142 are held between the nip plate 130 and the stay 160 as shown in FIG. 2. Thus, position of the reflection plate 140 relative to the nip plate 130 can be fixed.

Figure 5A:
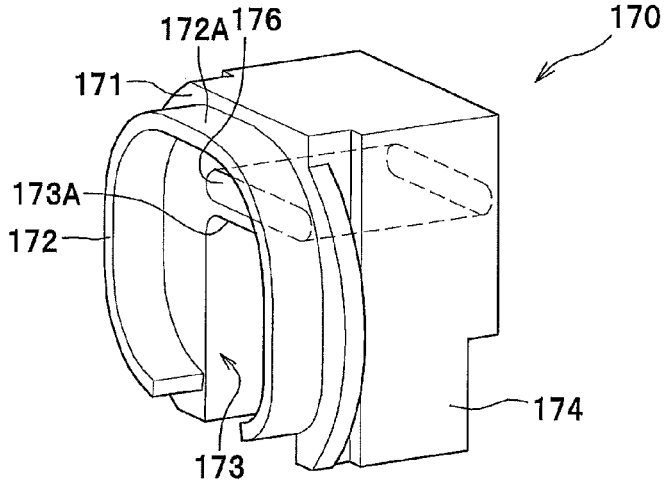
FIG. 5A is a perspective view of a guide member as viewed from a top side thereof.

The stay 160 holding the nip plate 130 and the reflection plate 140, and the halogen lamp 120 are directly fixed to a pair of the guide members 170 shown in FIG. 5A. That is, the guide members 170 integrally support the nip plate 130, the reflection plate 140, the stay 160, and the halogen lamp 120.

The guide member 170 is made from a thermally insulation material such as resin. Each of the guide members 170 is disposed at each of the widthwise end portions of the fusing film 110 for guiding circular movement of the fusing film 110. More specifically, each of the guide members 170 is provided to restrain movement of the fusing film 110 in the rightward/leftward direction (in an axial direction). Hereinafter, the guide member 170 disposed at the right end portion of the fusing film 110 will be referred to as the right guide member 170R, and the guide member 170 disposed at the left end portion of the fusing film 110 will be referred to as the left guide member 170L when it is necessary to distinguish between the two.

As shown in FIG. 5A, the guide member 170 includes a restricting surface 171 for restricting widthwise movement of the fusing film 110, a guide portion 172 for preventing the fusing film 110 from deforming radially inward, and a supporting recess 173 for supporting the front wall 161 and the rear wall 162 of the stay 160.

The guide portion 172 is a rib protruding inward from the restricting surface 171 in the rightward/leftward direction. The guide portion 172 has a generally C-shape having a bottom opening and a top wall 172A. The guide portion 172 is inserted into the tubular fusing film 110. That is, the guide portion 172 is in sliding contact with the inner peripheral surface of the fusing film 110 so as to restrain radially inward deformation of the fusing film 110. The bottom opening of the guide portion 172 serves as a space for accommodating the stay 160 that is inserted into the supporting recess 173.

Figure 5B:
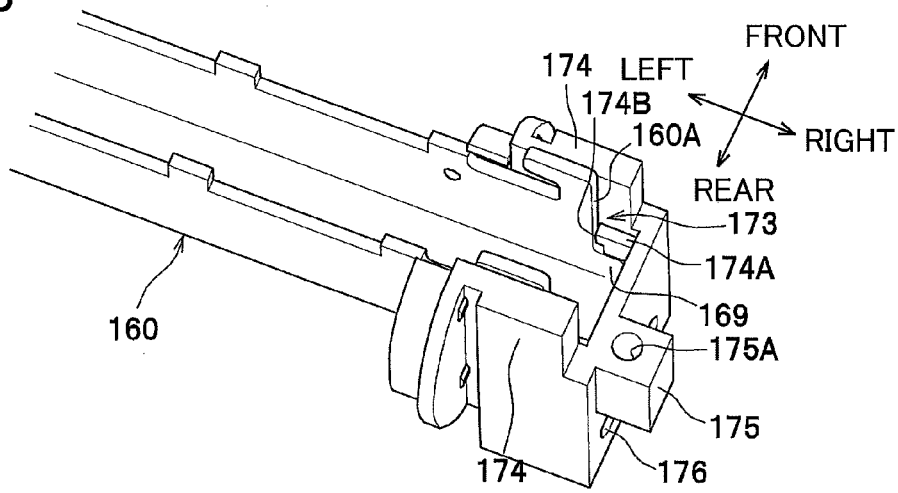
FIG. 5B is a perspective view of the guide member to which the stay is assembled as viewed from a bottom side thereof.
Figure 5C:
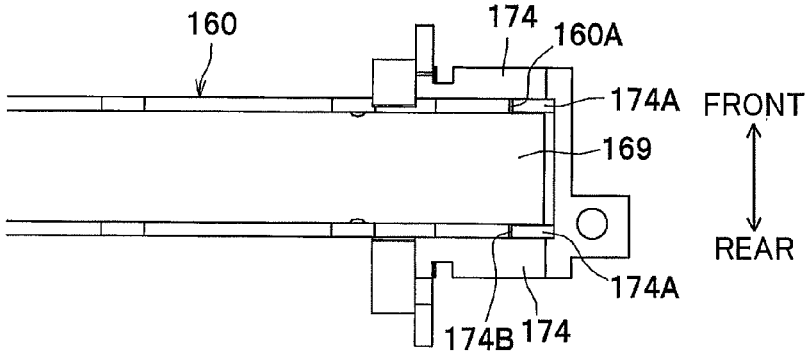
FIG. 5C is a bottom view of the guide member to which the stay is assembled.

The supporting recess 173 opens inward in the rightward/leftward direction and has a bottom opening. The supporting recess 173 has a top surface 173A (FIG. 5A). The guide member 170 has a pair of side walls 174 arranged in confrontation with each other in the frontward/rearward direction. The pair of the side walls 174 defines the supporting recess 173 therebetween. Each of the side walls 174 has a protruding portion 174A as shown in FIGS. 5B and 5C. The protruding portion 174A is formed so as to protrude inward from a portion spaced apart away from the top surface 173A.

As shown in FIG. 5B, each of the supported portions 169 of the stay 160 is inserted into a space between the top surface 173A and the pair of the protruding portions 174A. Hence, vertical movement of the supported portion 169 can be regulated by the top surface 173A and the pair of the protruding portion 174A. As a result, vertical displacement of the stay 160 relative to the guide member 170 can be restrained.

Further, each of the protruding portions 174A has an inner surface 174B in the rightward/leftward direction. The stay 160 has a pair of outer edge portions 160A (FIG. 5B) in the rightward/leftward direction. Each of the outer edge portions 160A is brought into abutment with each of the inner surfaces 174B. As a result, displacement of the stay 160 relative to the guide member 170 in the rightward/leftward direction (widthwise direction) due to vibration caused by operation of the fixing device 100 can be restrained by abutment of the protruding portions 174A with the stay 160.

Further, displacement of the stay 160 in the frontward/rearward direction can be restrained, since the stay 160 is supported between the pair of the side walls 174. As described above, the stay 160 is supported to the guide member 170, so that the nip plate 130 and the reflection plate 140 are integrally supported to the guide member 170 via the stay 160.

As shown in FIGS. 5B and 5C, the guide member 170 has a holding portion 175 protruding outward from the guide member 170 in the rightward/leftward direction. The holding portion 175 is provided to fix the halogen lamp 120 to the guide member 170. The holding portion 175 has a lower surface formed with a hole 175A into which a bolt (not shown) is inserted. The terminal 121 (FIG. 3) of the halogen lamp 120 is fixed to the lower surface of the holding portion 175 by the bolt.

In such a configuration that the nip plate 130 is pressed toward the pressure roller 150 by integrally moving the halogen lamp 120, the nip plate 130, the reflection plate 140, the stay 160 and the guide member 170, the terminal 121 can be electrically connected to a power source (not shown) provided in the main frame 2 of the laser printer 1 via a flexible line.

Further, as shown in FIG. 5A, each of the guide members 170 is formed with a through hole 176 extending in the rightward/leftward direction. Hereinafter, the through hole 176 formed in the right guide member 170R will be referred to as the right through hole (outlet opening) 176R, and the through hole 176 formed in the left guide member 170L will be referred to as the left through hole (inlet opening) 176L when it is necessary to distinguish between the two. The through hole 176 is provided at a position above the top surface 173A and below the top wall 172A. As shown in FIG. 6, when the stay 160 and the fusing film 110 are assembled to the guide member 170, the through hole 176 is brought into fluid communication with a space defined between the upper surface 160B of the stay 160 (the surface opposite to a surface of the stay 160 confronting the halogen lamp 120) and the fusing film 110.

The ventilation fan 25 is disposed above the right through hole 176R formed in the right guide member 170R. That is, the ventilation fan 25 is disposed at a level higher than that of the right through hole 176R. As shown in FIG. 6, the ventilation fan 25 allows air to move past the upper surface 160B of the top wall 166 from the left through hole 176L toward the right through hole 176R. The right through hole 176R is positioned downstream of the left through hole 176L in an airflow direction.

In other words, the ventilation fan 25 is adapted to allow air in the main frame 2 to discharge outside of the main frame 2 so as to allow air in a space defined by the right guide member 170R, the left guide member 170L, the stay 160, and the fusing film 110 to flow from the left through hole 176L to the right through hole 176R.

The left through hole 176L is shaped and positioned to apply the air to the upper surface 160B of the top wall 166 (i.e. a wall of the stay 160 opposite to the nip plate 130 relative to the halogen lamp 120). The right through hole 176R is shaped and positioned to facilitate discharging the air therethrough. The upper surface 160B of the top wall 166 that is exposed to the air flowing from the left through hole 176L to the right through hole 176R is spaced away from the nip plate 130. As a result, the stay 160 can be effectively cooled down without preventing the nip plate 130 from being heated by the halogen lamp 120.

Further, the right through hole 176R formed in the right guide member 170R is disposed at a level higher than that of the left through hole 176L formed in the left guide member 170L. With this configuration, even if the air flowing into the space defined between the stay 160 and the fusing film 110 from the left through hole 176L is heated by the top wall 166 of the stay 160, and thus tends to ascend, the ascending air can be efficiently discharged from the space through the right through hole 176R which is positioned above the left through hole 176L.

The laser printer 1 according to the above-described embodiment provides the following advantages and effects: operation of the ventilation fan 25 allows air in the space defined between the stay 160 and the fusing film 110 to flow in the axial direction through the through holes 176 formed in the pair of the guide members 170, so that the stay 160 can be cooled down. Accordingly, temperature elevation of the stay 160 can be restrained.

Each of the through holes 176 is disposed above the top wall 166 of the stay 160 that is spaced away from the nip plate 130. Therefore, temperature decrease of the nip plate 130 caused by cooling down of the stay 160 can be restrained.

The ventilation fan 25 allows air to move past the upper surface 160B of the top wall 166, and thus, the stay 160 can be cooled down by the air flowing from the left through hole 176L to the right through hole 176R. Accordingly, the resin guide members 170 that support the stay 160 can be prevented from melting by the heat transmitted from the stay 160. In other words, restraining temperature elevation of the stay 160 allows the guide members 170 to be made from resin. Therefore, the guide members 170 can be easily fabricated by resin.

The right through hole 176R is disposed at a level higher than that of the left through hole 176L positioned upstream of the right through hole 176R in the airflow direction. Since the air heated by the top wall 166 of the stay 160 ascends, the heated air can be efficiently discharged from the space defined between the fusing film 110 and the stay 160 through the right through hole 176R.

Figure 7:
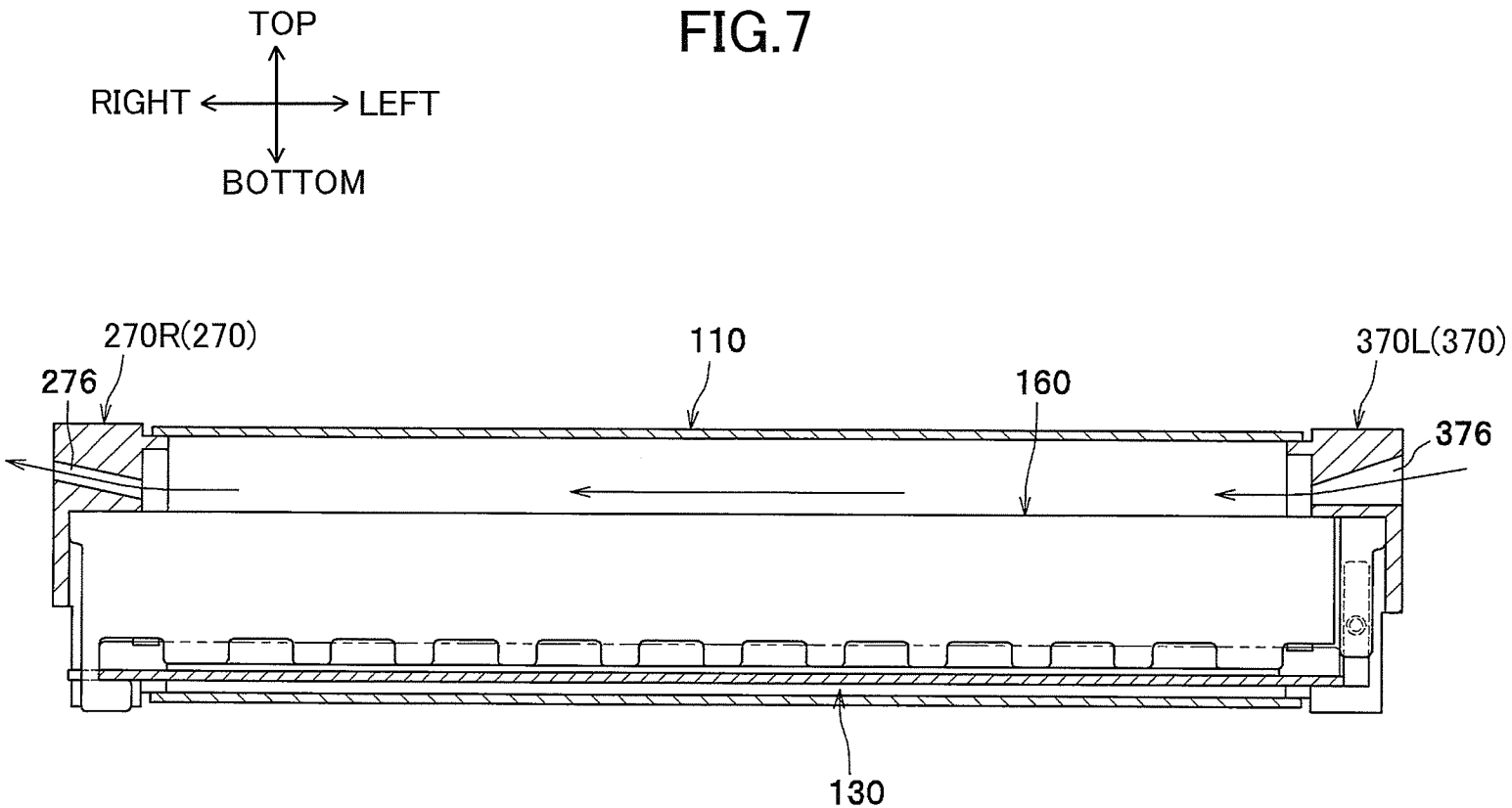
FIG. 7 is a cross-sectional view showing an assembled state of the fusing film, the nip plate, the stay, and the pair of the guide members, in which modifications of through holes formed in the guide members are shown.

Various modifications are conceivable. In the depicted embodiment, each of the through holes 176 horizontally extends through the respective guide member 170 in the rightward/leftward direction. However, as shown in FIG. 7, a right guide member 270R can be formed with a through hole 276 that extends diagonally upward toward the ventilation fan 25. The through hole 276 is positioned downstream of the left through hole 176L. With this configuration, the ventilation fan 25 disposed above the through hole 276 can easily discharge the air in the space defined between the stay 160 and the fusing film 110 through the through hole 276. As a result, airflow along the upper surface 160B of the top wall 166 of the stay 160 can be reliably generated.

Further, as shown in FIG. 7, a left guide member 370L can be formed with a through hole 376 having a tapered shape gradually decreasing in vertical length toward the right through hole 176R (the right through hole 276). The through hole 376 is positioned upstream of the right through hole 176R (the right through hole 276). With this configuration, a speed of the airflow along the upper surface 160B of the top wall 166 of the stay 160 can be increased. Therefore, cooling performance relative to the stay 160 can be improved.

Figure 8:
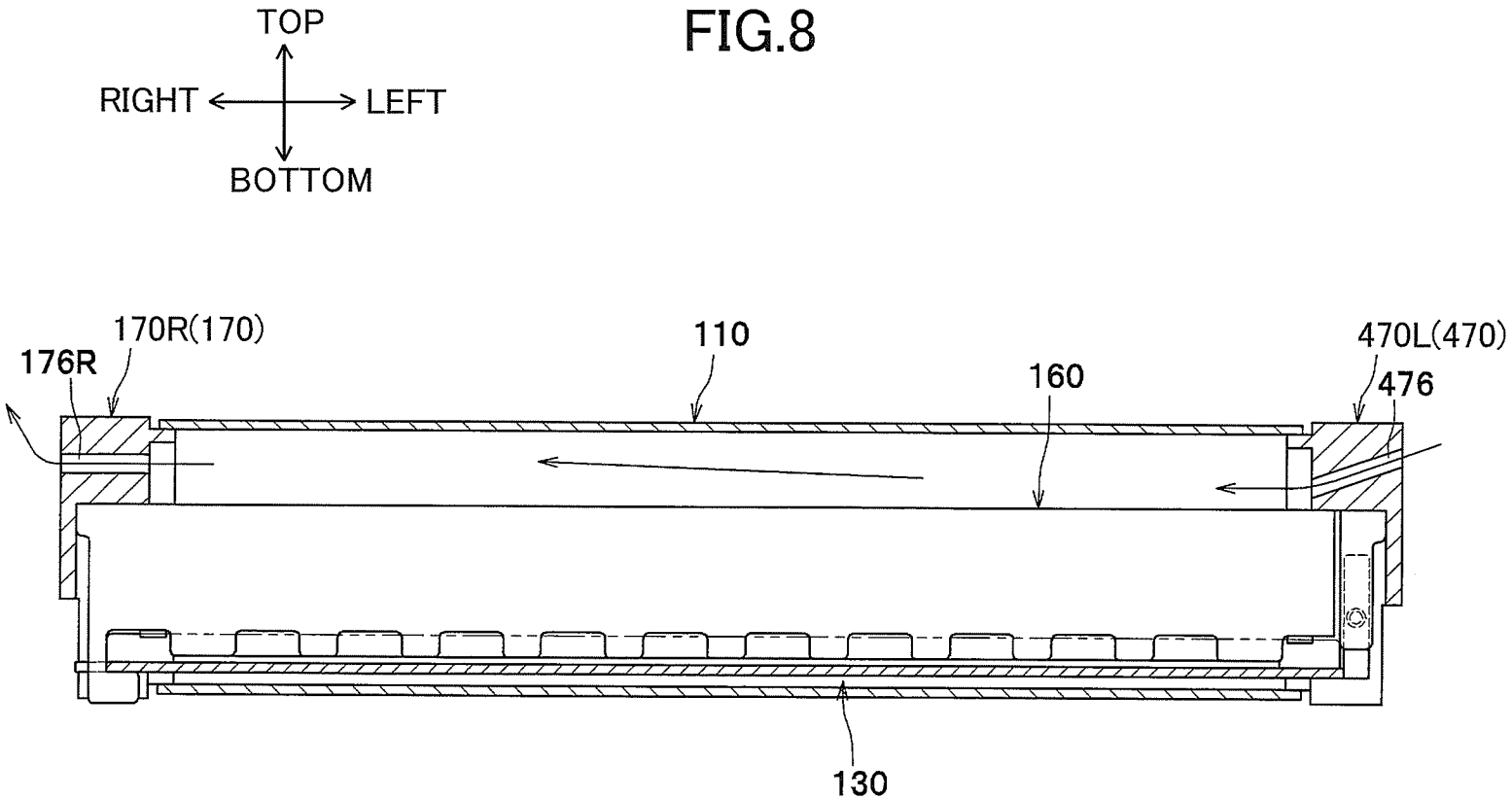
FIG. 8 is a cross-sectional view showing an assembled state of the fusing film, the nip plate, the stay, and the pair of the guide members, in which another modification of the through hole formed in the guide member is shown.

Further, as shown in FIG. 8, a left guide member 470L can be formed with a through hole 476 that extends diagonally downward toward the upper surface 160B of the top wall 166 so that the a right end of the through hole 476 approaches the stay 160. The through hole 476 is positioned upstream of the right through hole 176R. With this configuration, the stay 160 is exposed to the air flowing from the through hole 476. Accordingly, cooling performance relative to the stay 160 can be improved.

Figure 9:
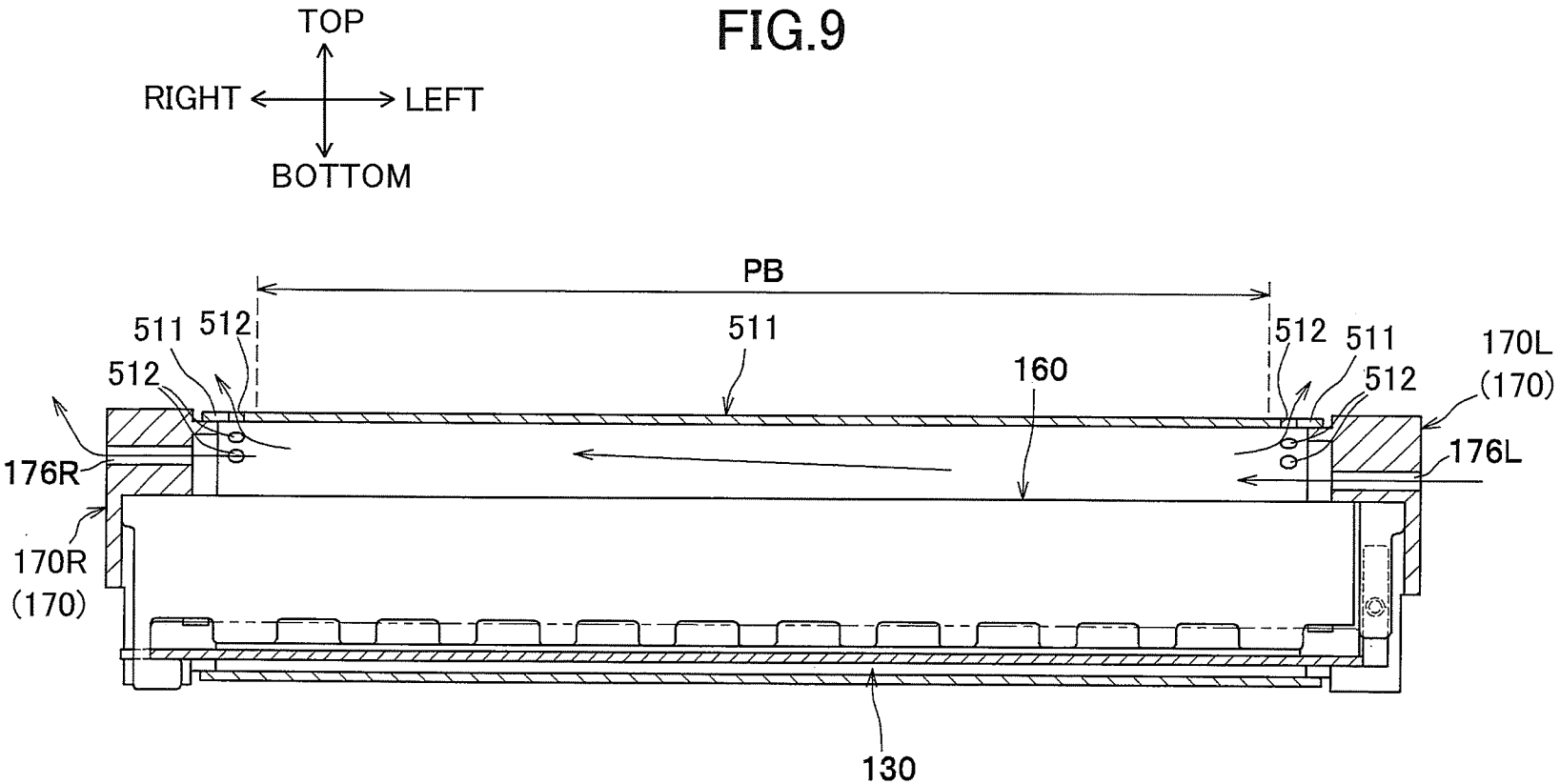
FIG. 9 is a cross-sectional view showing an assembled state of the fusing film, the nip plate, the stay, and the pair of the guide members, in which the fusing film is formed with air holes.

Further, as shown in FIG. 9, a plurality of air holes 512 can be formed in each of widthwise edge portions 511 of the fusing film 510 to allow air heated by the stay 160 to escape from the space defined between the fusing film 510 and the stay 160 threthrough. The edge portions 511 in which the plurality of air holes 512 are formed are positioned outside of a width PB of the sheet P in the rightward/leftward direction. With this configuration, accumulation of heated air in the space defined between the stay 160 and the fusing film 510 can be restrained. Accordingly, cooling performance relative to the stay 160 can be improved.

Only a single air hole 512 can be formed in the edge portion 511. Alternatively, the plurality of air holes 512 can be formed in only one of the edge portions 511. In particular, if the air hole 512 is formed in one of the edge portions 511 positioned downstream of remaining one of the edge portions 511 in the airflow direction, the heated air flowing over the upper surface 160B of the top wall 166 of the stay 160 can be efficiently discharged from the air hole 512. Thus, it is preferable that the air hole 512 is formed at least in one of the edge portions 511 positioned downstream of remaining one of the edge portions 511 in the airflow direction.

Figure 10:
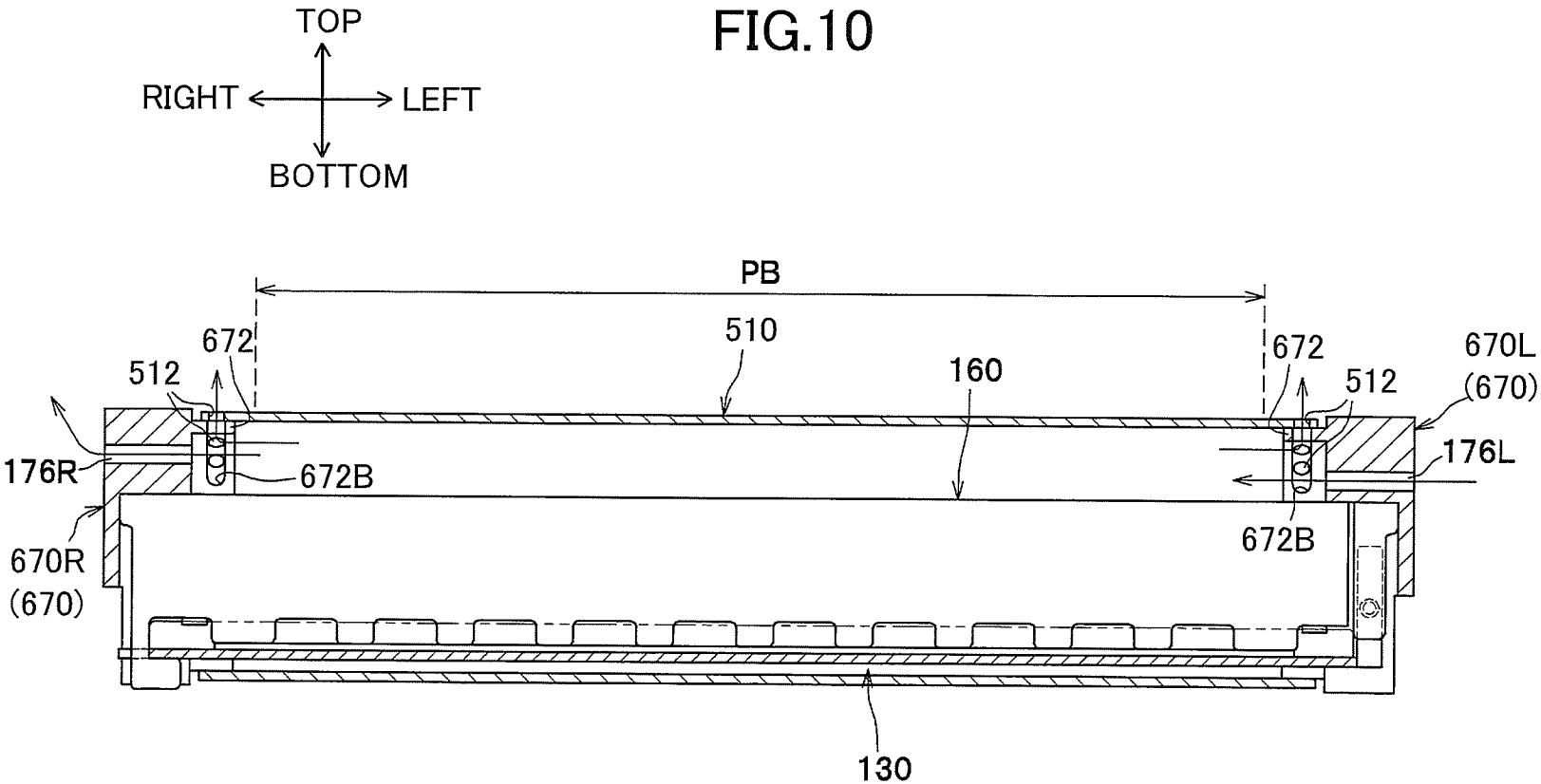
FIG. 10 is a cross-sectional view showing an assembled state of the fusing film, the nip plate, the stay, and the pair of the guide members, in which each of the guide members has a guide portion formed with a slit in communication with the air holes formed in the fusing film.

As shown in FIG. 10, the guide member 670 can be provided with the guide portion 672 having a slit 672B as a communication hole in fluid communication with the plurality of air holes 512 formed in the fusing film 510. The slit 672B is positioned in alignment with the air holes 512. With this configuration, the guide portion 672 has a length in the rightward/leftward direction greater than a length of the guide portion 172 without a slit. Accordingly, radially inward deformation of the fusing film 510 can be effectively restrained. Further, the air holes 512 can be formed in a portion of the fusing film 510 that is guided by the guide portion 672. Therefore, compared to a case where the guide portion 172 has a length in the rightward/leftward direction the same as that of the guide portion 672 so as to prevent the fusing film 110 to deform radially inward, the fusing film 510 can have a length in the rightward/leftward direction (axial direction) shorter than that of the fusing film 110. Thus, a compact fixing device 100 in the rightward/leftward direction can be provided.

Instead of the slit 672B, a plurality of through holes in coincident with the plurality of the air holes 512 are also available.

Further, in the depicted embodiment, the left through hole 176L is shaped and positioned to apply the air to the upper surface 160B of the top wall 166 of the stay 160, and the right through hole 176R is shaped and positioned to facilitate discharge the air therethrough. However, the left through hole 176L and the right through hole 176R can be formed in any portions of the guide members 170 as long as the left through hole 176L and the right through hole 176R can be communicated with the space defined between the inner peripheral surface of the fusing film 110 and the outer surface of the stay 160. For example, the left through hole 176L can be formed in the left guide member 170L so as to be shaped and positioned to apply the air to the front wall 161 or the rear wall 162. Further, the right through hole 176R can be formed in the right guide member 170R so as to be shaped and positioned to facilitate discharging the air therethrough.

Further, in the depicted embodiment, the stay 160 is disposed above the nip plate 130. However, if the pressure roller 150 is disposed above the nip plate 130, the stay 160 is disposed below the nip plate 130.

Further, in the depicted embodiment, the through hole 176 is formed in the guide member 170 for regulating movement of the fusing film 110 in the axial direction. However, in addition to the guide members 170 for guiding the fusing film 110, a frame can be provided. In the latter case, the through holes 176 can be formed in the frame.

Further, instead of the through hole 176, a groove formed in the guide member 170 is also available.

Further, in the depicted embodiment, the fixing device 100 includes the reflection plate 140 and the stay 160. However, the reflection plate 140 or the stay 160 can be dispensed with.

Further, in the depicted embodiment, an infrared ray heater or a carbon heater is available instead of the halogen lamp 120 (halogen heater).

Further, in the depicted embodiment, the nip plate 130 is employed as a nip member. However, a thick non-planar member is also available.

Further, in the depicted embodiment, the pressure roller 150 is employed as a backup member. However, a belt like pressure member is also available.

Further, in the depicted embodiment, the fixing device 100 is provided with the ventilation fan 25 for allowing air in the space defined between the stay 160 and the fusing film 110 to flow. However, in addition to the ventilation fan 25, an air blower can be provided in the main frame 2 to blow out air in the space defined between the stay 160 and the fusing film 110 through the through holes 176.

Further, the sheet P can be an OHP sheet instead of plain paper and a postcard.

Further, in the depicted embodiment, the image forming device is the monochromatic laser printer. However, a color laser printer, an LED printer, a copying machine, and a multifunction device are also available.

While the invention has been described in detail with reference to the embodiment thereof, it would be apparent to those skilled in the art that various changes and modifications may be made therein without departing from the spirit of the invention.

What is claimed is:

1. An image forming device comprising:

a heater configured to radiate radiant heat;

a nip member configured to receive the radiant heat from the heater;

a stay having an inner surface confronting the heater and an outer surface in opposition to the inner surface, the stay being configured to cover the heater and to support the nip member;

a tubular flexible fusing member having end portions in an axial direction and an inner peripheral surface, the fusing member being configured to surround the heater, the nip member and the stay;

a pair of frame members disposed at the end portions, one of the frame members being formed with an inlet opening, a remaining one of the frame members being formed with an outlet opening, the inlet opening and the outlet opening being in fluid communication with a space defined between the inner peripheral surface and the outer surface, each of the frame members having a guide portion, the inner peripheral surface being in sliding contact with each of the guide portions;

a backup member configured to provide a nip region in cooperation with the fusing member upon nipping the fusing member between the backup member and the nip member; and a ventilator configured to allow air to flow in the space in the axial direction from the inlet opening to the outlet opening, wherein each of the inlet opening and the outlet opening is positioned between the guide portion and the stay when viewed in the axial direction.

2. The image forming device as claimed in claim 1, wherein the inlet opening is shaped and positioned to apply the air to the outer surface of the stay and the outlet opening is shaped and positioned to facilitate discharging the air from the space.

3. The image forming device as claimed in claim 1, wherein each of the frame members is made from a resin and configured to be in contact with each of the end portions to regulate movement of the fusing member in the axial direction, the stay being supported to the frame members.

4. The image forming device as claimed in claim 1, wherein the outlet opening is disposed at a level higher than that of the inlet opening.

5. The image forming device as claimed in claim 1, further comprising a main frame supporting the ventilator and accommodating the heater, the nip member, the stay, the fusing member, the frame members, and the backup member, wherein the ventilator is configured to allow air in the main frame to be discharged outside of the main frame, whereby air flows in the space from the inlet opening to the outlet opening.

6. The image forming device as claimed in claim 5, wherein the ventilator is disposed at a level higher than that of the outlet opening.

7. The image forming device as claimed in claim 1, wherein the outlet opening extends diagonally upward toward the ventilator.

8. The image forming device as claimed in claim 1, wherein the inlet opening is of a tapered configuration gradually decreasing in vertical length toward the outlet opening.

9. The image forming device as claimed in claim 1, wherein the inlet opening extends diagonally downward toward the stay.

10. The image forming device as claimed in claim 1, wherein the fusing member has a portion positioned outside of a width of a sheet, the portion being formed with one or more air holes for allowing air heated by the stay to escape therethrough from the space.

11. The image forming device as claimed in claim 10, wherein each guide portion is formed with a communication hole in alignment with and in fluid communication with the one or more air holes.

12. The image forming device as claimed in claim 1, wherein the heater, the nip member, the stay, the fusing member, and the backup member constitute a fixing device for thermally fixing a developing agent image to a sheet fed in a sheet feeding direction; and wherein each of the inlet opening and the outlet opening has a shape elongated in the sheet feeding direction when viewed in the axial direction.

* * * * *